US007595593B2

(12) United States Patent
Genz et al.

(10) Patent No.: US 7,595,593 B2
(45) Date of Patent: Sep. 29, 2009

(54) METAL HALIDE LAMP WITH AN IONIZABLE FILL WITH VANADIUM AND RARE EARTHS, EXCLUDING MANGANESE

(75) Inventors: Andreas Genz, Berlin (DE); Martin Tüshaus, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 134 days.

(21) Appl. No.: 11/395,136

(22) Filed: Apr. 3, 2006

(65) Prior Publication Data

US 2006/0220563 A1 Oct. 5, 2006

(30) Foreign Application Priority Data

Apr. 1, 2005 (DE) ..... 20 2005 005 202 U

(51) Int. Cl.

| | |
|---|---|
| ***H01J 61/12*** | (2006.01) |
| ***H01J 61/82*** | (2006.01) |
| *H01J 17/04* | (2006.01) |
| *H01J 61/06* | (2006.01) |

(52) U.S. Cl. ..... 313/637; 313/634; 313/640; 313/539; 313/571

(58) Field of Classification Search ..... 313/627–643
See application file for complete search history.

(56) References Cited

U.S. PATENT DOCUMENTS

| | | | | |
|---|---|---|---|---|
| 3,331,982 | A * | 7/1967 | Koury et al. | 313/642 |
| 5,929,563 | A * | 7/1999 | Genz | 313/571 |
| 6,107,742 | A | 8/2000 | Seki et al. | |
| 6,307,321 | B1 * | 10/2001 | Honda et al. | 313/634 |
| 2003/0102808 | A1 * | 6/2003 | Dakin et al. | 313/640 |
| 2003/0184231 | A1 * | 10/2003 | Eisemann | 313/640 |
| 2004/0245930 | A1 * | 12/2004 | Tukamoto et al. | 313/631 |
| 2004/0253897 | A1 | 12/2004 | Graf et al. | |

FOREIGN PATENT DOCUMENTS

| | | |
|---|---|---|
| DE | 35 12 757 | 10/1986 |
| DE | 198 14 353 | 10/1998 |
| DE | 102 14 631 | 10/2003 |
| DE | 103 25 554 | 12/2004 |
| EP | 1455382 A2 * | 9/2004 |

* cited by examiner

*Primary Examiner*—Sikha Roy
*Assistant Examiner*—Tracie Green

(57) ABSTRACT

A metal halide fill for forming an ionizable fill comprises at least one inert gas, mercury and metal halides, the fill comprising the constituents V halide, Cs halide, Tl halide and halides of the rare earths. This fill may in particular be contained in the discharge vessel of a metal halide lamp.

11 Claims, 3 Drawing Sheets

METAL HALIDE LAMP WITH AN IONIZABLE FILL WITH VANADIUM AND RARE EARTHS, EXCLUDING MANGANESE

TECHNICAL FIELD

The invention is based on a metal halide lamp or a high-pressure discharge lamp having an ionizable fill comprising at least one inert gas, mercury, with at least one halogen, the fill comprising Tl, Cs and rare earths as metals. It deals in particular with fills for lamps with a luminous color similar to daylight.

BACKGROUND ART

To achieve luminous colors similar to daylight, metal halide discharge lamps generally contain thallium. By way of example, U.S. Pat. No. 6,107,742 describes a lamp which contains a metal halide fill comprising the metals Cs, Tl, and rare earths, such as Dy, Tm, Ho, and has a luminous color similar to daylight.

Moreover, US-A 2003184231 has disclosed a fill for metal halide lamps which contains V and Mn halide. The fill may additionally contain metal halides comprising the metals Cs, Tl, and rare earths, such as Dy, Tm, Ho. Mn is used as a replacement for Na. The purpose of this is to lower the color temperature.

Finally, DE-A 35 12 757 has disclosed a fill for metal halide lamps which contains a metal silicide, such as $V_5Si_3$. The fill additionally contains rare earth or Sc halide and the corresponding rare earth oxyhalide and/or Sc oxide. The silicide in this case acts as a halogen getter.

US-A 2004253897 has disclosed a metal halide lamp with a two-ended outer bulb which surrounds only part of the discharge vessel.

DISCLOSURE OF THE INVENTION

It is an object of the present invention to provide a metal halide fill for metal halide discharge lamps having an ionizable fill comprising at least one inert gas, mercury, with at least one halogen, the fill comprising Tl, Cs and rare earths as metals, which are adapted to particular conditions of an outer bulb.

This object is achieved by the following features: the fill additionally comprises V halide.

Particularly advantageous configurations are given in the dependent claims.

The invention uses a metal halide fill which uses Cs, Tl and rare earths and, in addition, V halide. Other components with further halides are not used. The halogen used is iodine and/or bromine. Mn is not used, since there is no need to lower the color temperature and, on the contrary, the aim tends to be a high color temperature of at least 5000 K. Given this objective, the color temperature is set primarily by the rare earths.

When producing metal halide lamps with discharge vessels made from quartz glass, it has been found that considerable cost savings can be achieved by using a new design with an outer bulb, in which the outer bulb only partially surrounds the discharge vessel. A gas fill is used in the outer bulb. However, this leads to an altered temperature balance for the discharge vessel. The fill comprising metal halides of Cs, Tl and rare earths that has hitherto been customary has too much of a green tinge under these conditions.

The accurately metered addition of vanadium halide remedies this problem. In this case, a fill which contains between 0.1 and 2.5 mg of rare earth halides per ml of volume of the discharge vessel is used. A value from 0.2 to 2.0 mg/ml is preferred. Suitable rare earths are in particular Dy, Ho and Tm alone or in combination. Dy alone is particularly preferred.

The molar ratio between rare earths and vanadium should be between 1.5 and 30, in particular between 2 and 20. Since both variables are trivalent, this range also applies to the associated metal halides. The fill preferably contains more iodine than bromine. In particular, iodine alone is used, with a bromine content of at most 10% in molar terms.

If the absolute fill quantity for rare earths is exceeded, the color temperature becomes too low. If the quantity of rare earths in the fill is below the absolute limit, the color temperature becomes too high.

If the molar ratio of RE to V is exceeded, the y component of the color locus becomes too high and the color locus has too much of a green tinge. If the molar ratio of RE to V is below the lower limit, the luminous flux becomes too low.

This fill is particularly suitable for relatively high-wattage lamps with a rated power of at least 100 W. It is suitable in particular also for lamps with a relatively high rated power of up to 400 W.

BRIEF DESCRIPTION OF THE DRAWINGS

The text which follows is intended to provide a more detailed explanation of the invention on the basis of a number of exemplary embodiments. In the drawings.

BEST MODE FOR CARRYING OUT THE INVENTION

Figure 1:
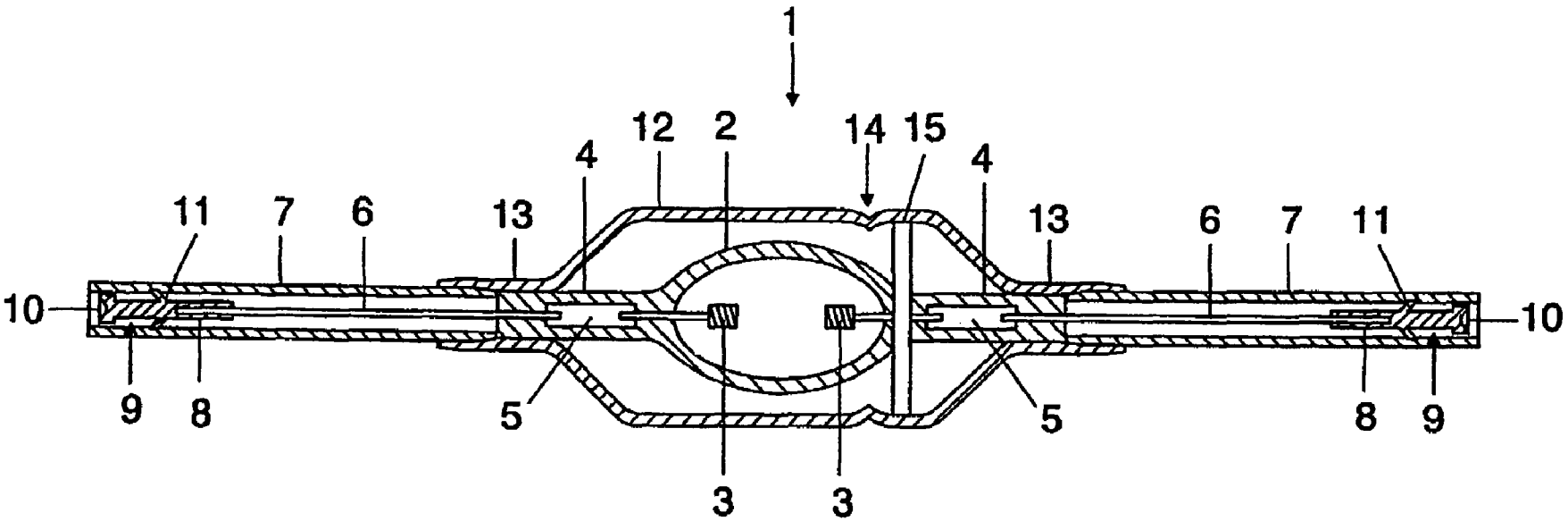
FIG. 1 shows a metal halide lamp according to the invention.

FIG. 1 shows a side view of a metal halide lamp 1 which is pinched on two sides. The discharge vessel 2 made from quartz glass, which is designed in the shape of a barrel, encloses two electrodes 3 as well as a metal halide fill. The bulb ends are sealed by pinches 4, in which foils 5 are embedded. A fused seal is also suitable for sealing purposes. These foils are connected to external supply conductors 6. The external supply conductor 6 is guided within a tubular sleeve 7 and ends in a socket 8 of an integral cap part 9. The cap is produced in a single piece from steel or other heat-resistant metal and also comprises a circular disk 10 as contact element and barb 11 as centering and holding means. The convex part of the discharge vessel is partly surrounded by an outer bulb 12, which is rolled on (13) in the region of the transition between the pinch 4 and the sleeve 7.

The outer bulb 12 has an encircling indentation 14, so that an elastic support strip 15 made from metal is spread along the inner surface of the outer bulb. The support strip may if necessary contain getter materials, such as Zr, Fe, V, Co. These materials are used to absorb various substances, such as oxygen, hydrogen or the like. The outer bulb may be filled with nitrogen, another inert gas or also a vacuum.

In another exemplary embodiment, an outer bulb gas mixture of $N_2$ and/or $CO_2$ with Ne is used to improve the ignition properties, in which case the total pressure is between 200 and 900 mbar. In this case, the starting gas used in the burner is an Ne—Ar—, Ne—Kr— or Ne—Ar—Kr Penning mixture. In particular an outer bulb gas mixture of $N_2$/Ne or $CO_2$/Ne with a total pressure of from 300 mbar to 900 mbar is used to maintain the good ignition properties throughout the service life. The Ne in this case forms between 25 and 60%.

Figure 2:
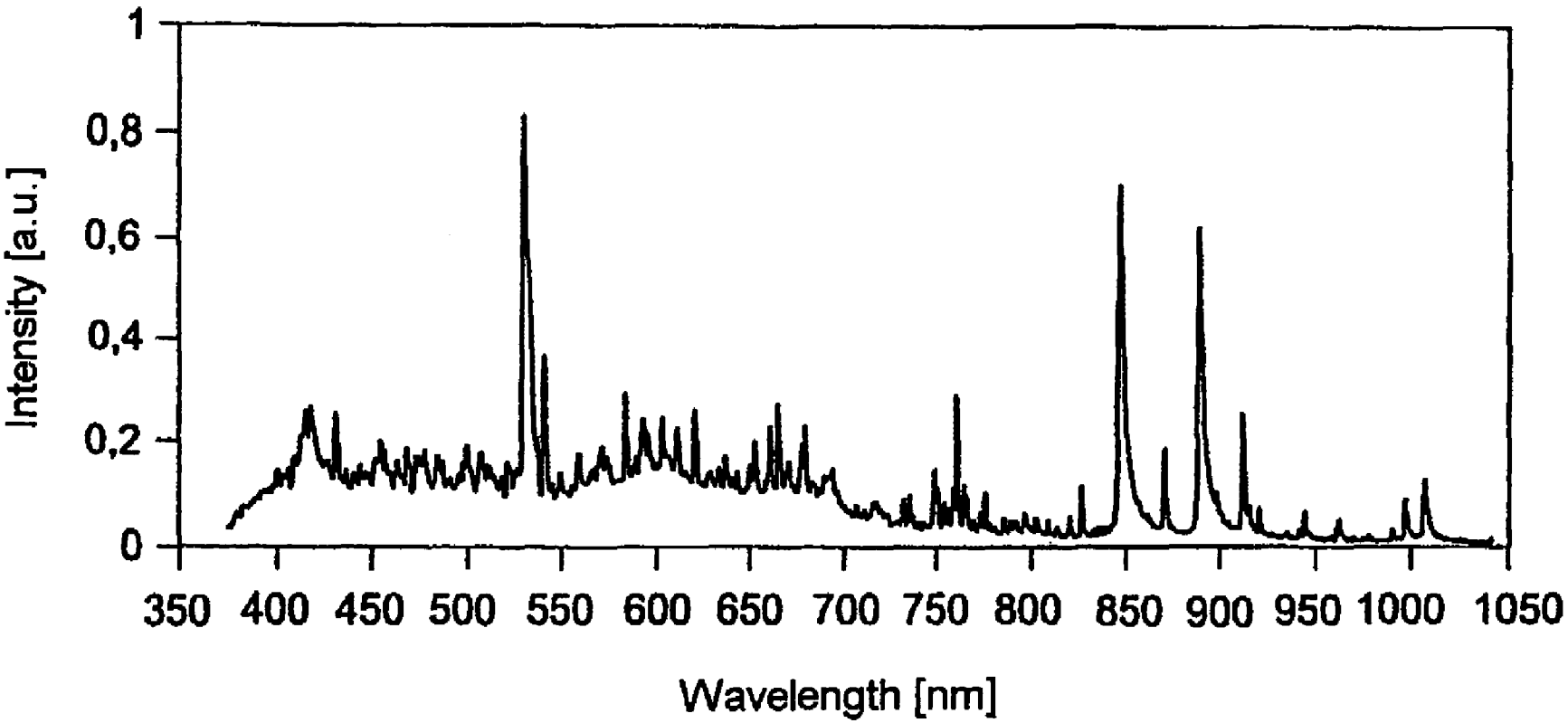
FIG. 2 shows a spectrum of this lamp.

FIG. 2 shows the spectrum of a 150 W lamp after a burning time of 100 h in accordance with the exemplary embodiment shown in FIG. 1, the discharge vessel of which contains 15 mg of Hg and the metal halide fill shown in Table 1. The fill in the outer bulb is argon.

As rare earth, the lamp uses Dy alone. Good results are also achieved with an addition of Tm and Ho if Dy is used predominantly, representing a proportion of more than 50%.

Figure 3A:
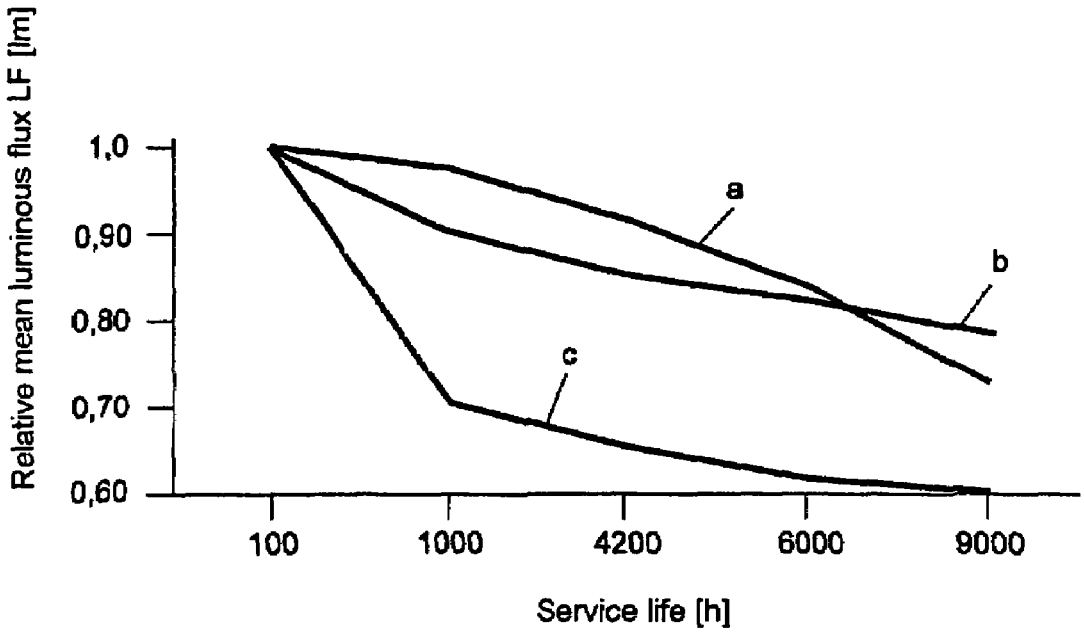
FIG. 3 shows the change in color temperature over the life of this lamp.
Figure 3B:
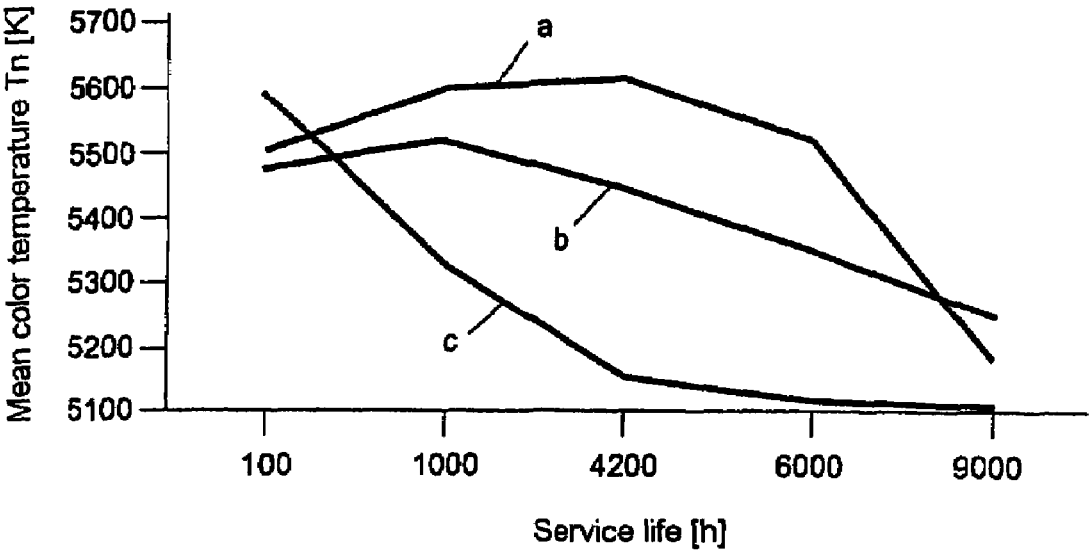

FIG. 3 shows the change in the luminous flux LF (FIG. 3*a*, curve a) and the color temperature Tn (FIG. 3*b*, curve a) of the lamp from FIG. 1 as a function of the service life. Both characteristic variables are extremely stable until a service life of at least 6000 hours.

Table 1 shows a further exemplary embodiment relating to a 250 W lamp and a 400 W lamp with daylight fill. In both cases, the fill is of similar composition to the 150 W exemplary embodiment. The corresponding profiles of the luminous flux and the color temperature are plotted in FIGS. 3*a* and 3*b* as curves b) for the 250 W exemplary embodiment and c) for the 400 W exemplary embodiment.

TABLE 1

| | Power/W | | |
|---|---|---|---|
| | 150 | 250 | 400 |
| Luminous flux/lm | 11 000 | 18 500 | 35 000 |
| Color temperature/K | 5500 | 5500 | 5600 |
| Mean service life/h | 9000 | 9000 | 9000 |
| Electrode gap/mm | 15 | 27.5 | 30.5 |
| Burner bulb diameter/mm | 14.8 | 18 | 24 |
| Burner bulb length/mm | 22.3 | 32 | 46 |
| Bulb volume/ml | 1.6 | 5.2 | 14.5 |
| Burner fill gas | 100 hPa Ar | 100 hPa Ar | 100 hPa Ar |
| Outer bulb fill gas | 300 hPa Ar | Vacuum | Vacuum |
| Fill in mg | 15 mg Hg,<br>0.41 mg CsJ,<br>1.53 mg DyJ3,<br>0.47 mg TlJ,<br>0.1 mg VJ3 | 14 mg Hg,<br>0.90 mg CsJ,<br>3.35 mg DyJ3,<br>1.0 mg TlJ,<br>0.2 mg VJ3 | 60 mg Hg,<br>1.8 mg CsJ,<br>6.7 mg DyJ3,<br>2.0 mg TlJ,<br>0.4 mg VJ3 |
| Metals in mol % | Cs 26%<br>Dy 46%<br>Tl 23%<br>V 5% | Cs 26%<br>Dy 46%<br>Tl 23%<br>V 5% | Cs 26%<br>Dy 46%<br>Tl 23%<br>V 5% |

What is claimed is:

1. A metal halide lamp having an ionizable fill comprising at least one inert gas, mercury, with at least one halogen, the fill comprising Tl, Cs and rare earths as metals, wherein the fill additionally comprises V halide and no manganese.

2. The metal halide lamp as claimed in claim 1, wherein at least one halide from the group of the rare earths Dy, Ho, Tm is used.

3. The metal halide lamp as claimed in claim 1, wherein the fill contains between 0.1 and 2.5 mg of RE halide per ml of bulb volume of the discharge vessel.

4. The metal halide lamp as claimed in claim 1, wherein iodine, bromine or combinations thereof are used as halogens for forming halides.

5. The metal halide lamp as claimed in claim 4, wherein iodine, with at most 10 mol % of bromine is used as the halogen.

6. The metal halide lamp as claimed in claim 1, wherein the molar ratio between rare earths and vanadium is between 1.5 and 30.

7. The metal halide lamp as claimed in claim 1, wherein the lamp also comprises: an outer bulb made from hard glass or quartz glass enclosing a discharge vessel (2) made from quartz glass with two electrodes (11) therein, which electrodes are held in seals, the outer bulb being secured at the seals, and with a space between the discharge vessel and the outer bulb.

8. The metal halide lamp as claimed in claim 7, wherein the space between discharge vessel and outer bulb contains a gas fill.

9. The metal halide lamp as claimed in claim 8, wherein the gas fill consists of 200 to 900 mbar $N_2$ or noble gas or $CO_2$ alone or in combination.

10. The metal halide lamp as claimed in claim 2, wherein Dy is in a proportion of more than 50% of the rare earth total.

11. The metal halide lamp as claimed in claim 6, wherein the molar ratio between rare earths and vanadium is between 2 and 20.

* * * * *